United States Patent [19]

Bowman

[11] Patent Number: 4,849,072

[45] Date of Patent: Jul. 18, 1989

[54] ELECTROLYTIC PROCESS FOR RECOVERING LITHIUM FROM ALUMINUM-LITHIUM ALLOY SCRAP

[75] Inventor: Kenneth A. Bowman, Kiski Township, Armstrong County, Pa.

[73] Assignee: Aluminum Company of America, Pittsburgh, Pa.

[21] Appl. No.: 98,984

[22] Filed: Sep. 21, 1987

[51] Int. Cl.[4] ..... C25C 3/02

[52] U.S. Cl. ..... 204/68

[58] Field of Search ..... 204/68

[56] References Cited

U.S. PATENT DOCUMENTS

| | | | |
|---|---|---|---|
| 1,534,315 | 4/1925 | Hoopes | 204/67 |
| 1,534,316 | 4/1925 | Hoopes et al. | 204/67 |
| 1,534,317 | 4/1925 | Hoopes et al. | 204/67 |
| 1,534,318 | 4/1925 | Hoopes et al. | 204/67 |
| 1,534,319 | 4/1925 | Hoopes et al. | 204/67 |
| 1,534,320 | 4/1925 | Hoopes | 204/67 |
| 1,534,321 | 4/1925 | Hoopes | 204/67 |
| 1,534,322 | 4/1925 | Hoopes et al. | 204/67 |
| 1,535,458 | 4/1925 | Frary | 204/67 |
| 1,562,090 | 11/1925 | Hoopes | 204/67 |
| 3,904,494 | 9/1975 | Jacobs et al. | 204/67 |
| 3,962,064 | 6/1976 | Brut et al. | 204/245 |
| 4,156,635 | 5/1979 | Cooper et al. | 204/68 |
| 4,183,745 | 1/1980 | Tsumura | 85/68 R |
| 4,209,496 | 6/1980 | Carpenter et al. | 423/210 |
| 4,248,630 | 2/1981 | Balmuth | 75/135 |
| 4,385,964 | 5/1983 | Johnson et al. | 203/50 |
| 4,390,364 | 6/1983 | Yu | 75/67 A |
| 4,405,416 | 9/1983 | Raistrich et al. | 204/68 |
| 4,411,747 | 10/1983 | Dawless et al. | 204/67 |
| 4,430,174 | 2/1984 | Tsumura | 204/67 |
| 4,436,627 | 3/1984 | McMonigle | 210/695 |
| 4,455,202 | 6/1984 | Sintim-Damoa et al. | 204/68 |
| 4,456,479 | 6/1984 | Harris et al. | 75/63 |

FOREIGN PATENT DOCUMENTS

| | | |
|---|---|---|
| 2933065 | 1/1981 | Fed. Rep. of Germany . |
| 54-43811 | 4/1979 | Japan . |

OTHER PUBLICATIONS

Junius David Edwards et al., "The Aluminum Industry, Aluminum and its Production," McGraw-Hill Book Company, Inc., New York, 1930, pp. 322-327.

Basant L. Tiwari et al., "Electrolytic Extraction of Magnesium from Commercial Aluminum Alloy Scrap," *Physical Chemistry of Extractive Metallurgy,* AIME, New York, Feb. 1985, pp. 147-164.

Basant L. Tiwari, "Demagging Processes for Aluminum Alloy Scrap," *Journal of Metals,* Jul. 1982, pp. 54-58.

M. Schofield, "Developments in Lithium Technology," *Metallurgia,* Dec. 1964, pp. 278-280.

Joseph S. Smatko, "The Lithium Electrolytic Cell," published by the Office of Military Government for Germany, Apr. 1, 1946.

R. R. Rogers et al., "The Production of Lithium Metal," *The Canadian Mining and Metallurgical Bulletin,* Nov. 1948, pp. 623-628.

Richard Bauer, "Lithium-Electrochemical Aspects," Chemi-Ing. Techn., 44, (4), 1972, pp. 147-151.

*Primary Examiner*—R. L. Andrews

*Attorney, Agent, or Firm*—Douglas G. Glantz

[57] ABSTRACT

A recovery process is disclosed for reclaiming the lithium content from aluminum-lithium alloy scrap including establishing a three-layered electrolytic cell comprising a most dense lowest layer of molten aluminum-lithium alloy, a middle layer of molten salt electrolyte, and an uppermost layer of molten aluminum-lithium; maintaining the lowest layer of molten aluminum-lithium alloy at a positive DC voltage with respect to the uppermost layer of molten lithium; establishing a current flow through the cell; establishing a specified composition in the molten salt electrolyte such that lithium in the lowest layer is electrochemically oxidized and passes into the molten salt electrolyte as lithium ions and further such that said lithium ions are electrochemically reduced and pass into the uppermost layer as lithium metal; and withdrawing lithium from the uppermost layer.

20 Claims, 1 Drawing Sheet

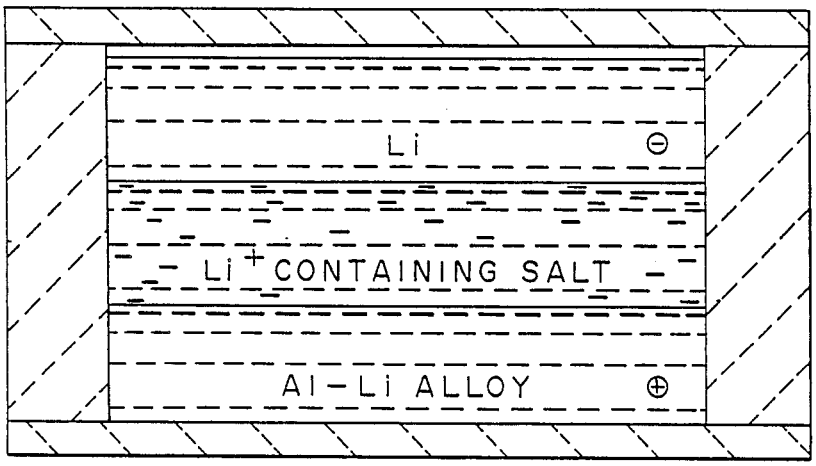
Li ⊖
Li+ CONTAINING SALT
Al-Li ALLOY ⊕

ELECTROLYTIC PROCESS FOR RECOVERING LITHIUM FROM ALUMINUM-LITHIUM ALLOY SCRAP

BACKGROUND OF THE INVENTION

This invention relates to a recovery process for reclaiming the lithium contact from aluminum-lithium alloy scrap.

Aluminum-lithium alloy currently is receiving more attention as a candidate for use in structural metal applications in the aerospace industry. Aluminum-lithium alloys offer the advantage of lighter weight and high structural integrity, making these alloys attractive to the aerospace industry for saving fuel.

Large quantities of scrap are generated for every pound of metal used in an aircraft. It is desirable to recycle most of the scrap into ingot form. An aluminum-lithium alloy scrap having about 2.5% lithium content by weight has a value of about fifty cents per pound for the lithium in addition to the aluminum value of about fifty cents per pound. For this reason, it is desirable to recover both lithium and lithium-free aluminum.

However, since several different alloys are needed, mixed scrap may not be recyclable in whole or even in part by melting the scrap and forming the ingot directly. If scrap cannot be recycled into new aluminum-lithium ingot, some method must be found to remove and recover the lithium from the scrap.

It is an object of the present invention to provide a process for recovering the lithium content from aluminum-lithium alloy scrap.

SUMMARY OF THE INVENTION

The invention provides a process for recovering lithium content from aluminum-lithium alloy scrap including establishing a three-layered eletrolysis cell including a most dense lowest layer of molten aluminum-lithium alloy, a middle layer of molten salt electrolyte, and an uppermost layer of molten lithium, maintaining the lowest layer of molten aluminum-lithium at a positive DC voltage with respect to the uppermost layer of molten lithium, establishing a current flow through the cell, establishing a specified composition of said molten salt electrolyte such that lithium in the lowest layer is electrochemically oxidized and passes into the molten salt electrolyte as lithium ions and further such that the lithium ions are electrochemically reduced and passed into the uppermost layer as lithium metal, and withdrawing lithium from the uppermost layer.

THE DRAWING

The sole Figure is a schematic elevation view of a three-layered electrolytic cell used in accordance with the process of the present invention.

DETAILED DESCRIPTION

The process of the present invention provides a technically feasible way of recovering the lithium content from aluminum-lithium alloy scrap. The remaining aluminum component of the scrap is also made more usable by having the lithium removed.

The process of the present invention employs an electrolytic cell having three different layers which float on one another. The most dense lowest layer is an impure pool of aluminum-lithium alloy. The middle layer is a molten salt electrolyte which contains ions of the metal to be transported away from the aluminum-lithium alloy, specifically lithium in this case. The uppermost layer is the recovered metal, lithium.

In the electrolytic cell of the present invention, the lowest layer is an anode and, therefore, it is held at a positive voltage with respect to the recovered lithium pool. When current is made to flow through the cell, the metal of the impure alloy which is least noble is electrochemically oxidized and passes into the molten salt electrolyte as ions. Provided that these ions are the easiest ones in the electrolyte to be reduced at a cathode, then the metal which is removed from the lowest layer is recovered at the uppermost layer. The cathode of the cell may either be the floating pool of lithium metal, or it may be a rigid cathode made of a metal which is compatible in the system, low carbon steels, for example.

Referring to the Figure, a schematic elevation view of a three-layered cell is depicted. Aluminum-lithium alloy is shown at the lowest layer. The middle layer of molten salt electrolyte is shown as having lithium ions contained in the salt. The uppermost layer is shown as lithium. The aluminum-lithium alloy is shown having a positive electrical charge compared to a negative charge on the lithium layer.

The molten salt electrolyte must contain lithium chloride or lithium fluoride, and other chlorides and fluorides of potassium and calcium would be desirable. The molten salt electrolyte must not contain reducible or oxidizable impurities that can chemically react with either the lithium cathode or the aluminum-lithium anode metals, i.e., nitrate, nitrite, sulfate, sulfite, ferrous, ferric, magnesium ion, sodium ion, aluminum ion, or carbonate. With only lithium salts present, it is believed that the lithium metal is sufficiently soluble in the electrolyte that recovery would be poor. The presence of calcium and potassium halides, however, reduces the solubility of lithium in the electrolyte.

The density of the aluminum-lithium alloy is a threshold determinant of the process of the present invention. That is, the density of the molten salt electrolyte must be selected to be lower than the density of the aluminum-lithium alloy and higher than lithium metal to setup the three-layered process of the present invention. Otherwise, the layers will not separate sufficiently to permit operation of the cell in accordance with the process of the present invention. In this regard, the densities of the three layers must be maintained at temperatures anticipated for the operation of the process of the present invention.

As the lithium content of the aluminum-lithium alloy is lowered, a point will be reached where the available lithium will be insufficient to maintain the electrolyte current through the cell. As the current continues to flow, an increasing proportion of the imposed current will be supported by other metals of the alloy entering the electrolyte as ions. These other metals will first be magnesium, if present, and then aluminum. Since those metals are more difficult to anodize into the electrolyte than lithium, they will be more easily reduced and recovered at the cathode, thus appearing as impurities in the lithium. To prevent this from happening, either the current density will be reduced as the lithium content in the alloy decreases, or the alloy will be removed from the cell when the lithium content is decreased to a predetermined level. This removed alloy can be treated in a lower current density cell to recover lithium further if desired.

Aluminum-lithium alloys presently being developed for aerospace applications contain approximately 0.12% zirconium. The zirconium will remain with the aluminum portion of the treated alloy and will need to be removed to increase the usability of this metal. The zirconium can be removed by fractional crystallization or other processing steps effective at reducing the zirconium content.

Other processes for removing lithium from an aluminum-lithium alloy may require less power to transport the lithium, e.g., such as in a diaphragm cell, but the process of the present invention provides advantages of decreased mechanical complexity and lower cost of key materials. The process of the present invention can be engineered to operate in either a batch or continuous mode.

While the invention has been described in terms of preferred embodiments, the claims appended hereto are intended to encompass all embodiments which fall within the spirit of the invention.

What is claimed is:

1. A process for recovering lithium from aluminum-lithium alloy comprising:

(a) establishing a three-layered electrolysis cell comprising a most dense lowest layer of molten aluminum-lithium alloy, a middle layer of molten salt electrolyte, and an uppermost layer of molten lithium;

(b) applying a positive DC voltage on said lowest layer of molten aluminum-lithium alloy with respect to said uppermost layer of molten lithium, and passing a current through the cell for oxidizing lithium in said lowest layer to pass lithium ions electrochemically into said molten salt electrolyte and for reducing said lithium ions electrochemically to pass into said uppermost layer as lithium metal; and (c) withdrawing lithium from said uppermost layer.

2. The process as set forth in claim 1 further comprising feeding aluminum-lithium scrap to the cell as the source of said alloy.

3. The process as set forth in claim 2 comprising operating said cell continuously.

4. The process as set forth in claim 1 wherein said aluminum-lithium alloy comprising an anode and said lithium metal comprises the cathode.

5. The process as set forth in claim 1 wherein said aluminum-lithium alloy comprises an anode and said process further comprises establishing a cathode comprising a solid rigid metal.

6. The process as set forth in claim 5 wherein said cathode comprises low carbon steel.

7. The process as set forth in claim 1 wherein said electrolyte contains lithium chloride.

8. The process as set forth in claim 7 wherein said electrolyte comprises lithium fluoride.

9. The process as set forth in claim 8 wherein said electrolyte further comprises chlorides and fluorides of potassium and calcium.

10. The process as set forth in claim 9 further comprising reducing current density as lithium content decreases in the lowest layer.

11. The process as set forth in claim 10 further comprising removing alloy from the cell when the lithium content decreases below a predetermined level.

12. The process as set forth in claim 11 wherein said aluminum-lithium alloy contains zirconium.

13. The process as set forth in claim 12 further comprising removing zirconium by fractional crystallization.

14. A batch process for recovering the lithium content from aluminum-lithium alloy comprising:

(a) establishing a three-layered electrolysis cell comprising a most dense lowest layer of molten aluminum-lithium alloy, a middle layer of molten salt electrolyte, and an uppermost layer of molten lithium;

(b) applying a positive DC voltage on said lowest layer of molten aluminum-lithium alloy with respect to said uppermost layer of molten lithium, and passing a current through the cell for oxidizing lithium in said lowest layer electrochemically to pass into said molten salt electrolyte as lithium ions and for reducing said lithium ions electrochemically to pass into said uppermost layer as lithium metal;

(c) withdrawing lithium from said uppermost layer; and (d) withdrawing aluminum from said lowest layer.

15. The process as set forth in claim 14 comprising withdrawing aluminum from said lowest layer only when lithium content decreases below a predetermined level.

16. The process as set forth in claim 15 wherein said aluminum-lithium alloy contains zirconium.

17. The process as set forth in claim 16 further comprising removing zirconium from said aluminum withdrawn from the lowest layer by fractional crystallization.

18. The process as set forth in claim 17 further comprising feeding aluminum-lithium scrap to the cell as the source of said alloy.

19. The process for recovering lithium content from aluminum-lithium alloy aerospace comprising the following steps performed continuously:

(a) establising a three-layered electrolysis cell comprising a most dense lowest layer of molten aluminum-lithium alloy, a middle layer of molten salt electrolyte, and an uppermost layer of molten lithium;

(b) applying a positive DC voltage on said lowest layer of molten aluminum-lithium alloy with respect to said uppermost layer of molten lithium, and establishing a current flow through the cell for oxidizing lithium in said lowest layer electrochemically to pass as lithium ions and for reducing said lithium ions electrochemically to pass into said uppermost layer as lithium metal; and (c) withdrawing lithium from said uppermost layer.

20. The process as set forth in claim 19 further comprising feeding aluminum-lithium scrap to the cell as the source of said alloy.

* * * * *